US006557789B1

(12) United States Patent
Haas

(10) Patent No.: US 6,557,789 B1
(45) Date of Patent: May 6, 2003

(54) MANUAL SPRAY COATING GUN

(75) Inventor: Gerald Haas, St. Gallen (CH)

(73) Assignee: ITW Gema AG, St. Gallen (CH)

( * ) Notice: Subject to any disclaimer, the term of this patent is extended or adjusted under 35 U.S.C. 154(b) by 0 days.

(21) Appl. No.: 09/763,321

(22) PCT Filed: Jun. 9, 1999

(86) PCT No.: PCT/EP99/03966

§ 371 (c)(1),
(2), (4) Date: Apr. 17, 2001

(87) PCT Pub. No.: WO00/10723

PCT Pub. Date: Mar. 2, 2000

(30) Foreign Application Priority Data

Aug. 22, 1998 (DE) ..... 198 38 275

(51) Int. Cl.[7] ..... B05B 5/00

(52) U.S. Cl. ..... 239/707; 239/71; 239/526; 239/690; 239/704; 239/708

(58) Field of Search ..... 239/71, 73, 74, 239/79, 85, 525, 526, 690, 704, 706, 707, 708; 118/300, 308

(56) References Cited

U.S. PATENT DOCUMENTS

| | | | | | |
|---|---|---|---|---|---|
| 3,008,645 | A | | 11/1961 | Morel | |
| 3,740,612 | A | * | 6/1973 | Gauthier et al. | 239/706 |
| 4,216,915 | A | | 8/1980 | Hengarther | |
| 4,437,614 | A | * | 3/1984 | Garcowski | 239/691 |
| 4,441,656 | A | * | 4/1984 | Huber | 239/708 |
| 4,653,696 | A | | 3/1987 | Rath | |
| 4,682,735 | A | * | 7/1987 | Mommsen | 239/690 |
| 5,080,289 | A | | 1/1992 | Lunzer | |
| 5,503,880 | A | * | 4/1996 | Matschke | 239/690 |
| 5,678,770 | A | * | 10/1997 | Shah | 239/690 |

* cited by examiner

*Primary Examiner*—Steven J. Ganey
(74) *Attorney, Agent, or Firm*—Lowe Hauptman Gilman & Berner, LLP

(57) ABSTRACT

A manual spray-coating gun comprising at least one manual setting/operating element (40, 42) to manually change operational values and transmitting the desired operational values to a control unit (4) situated outside the gun.

16 Claims, 1 Drawing Sheet

MANUAL SPRAY COATING GUN

FIELD OF THE INVENTION

The present invention relates to a manual spray-coating gun.

BACKGROUND ART

A manual spray gun for powder or granulate coating material is known from U.S. Pat. No. 4,196,465. It contains a barrel and a grip. The index finger encloses a rigger. Squeezing the trigger switches ON the supply of coating material to the spray gun and releasing the trigger shuts it OFF. The electric power supply to one or more high-voltage electrodes electrostatically charging the coating material is switched ON and OFF simultaneously with squeezing and releasing the trigger. A high-voltage generator feeding the electrode is housed in the gun and by means of a low-voltage cable is connected to a low-voltage DC source and contains an oscillator, a transformer and a cascade circuit of resistors and capacitors. The powder coating material is pneumatically fed by a pump in the form of an injector of the design disclosed in the German patent document 1,266,685 C to the gun. Moreover it is known from the German patent document 34 02 945 C to mount a display on the back side of the gun to generate an optical signal as a function of the electrode's voltage level. U.S. Pat. No. 4,441,656 discloses a manual spray gun to electrostatically coat objects with a liquid coating material. Its trigger allows opening or closing a valve housed in the gun and controlling the feed of coating material. Also guns are known in the state of the art that are designed with continuous liquid-coating feed during coating pauses, during which said feed is recirculated by the gun to the source of liquid.

The known spray coating guns is connected to an electric control unit several meters away and allowing adjusting the rate of coating material and the voltage level of the minimum of one high-voltage electrode.

SUMMARY OF THE INVENTION

In accordance with the invention, the control unit frequently is several meters away from the operator who in turn must stand near a coating station or cabin and must observe the spraying of the coating material onto an object to be coated. The invention offers the advantage that the operator is able to set the operational values directly by hand at the spray gun and therefore need not go to the control unit. This feature is especially significant when the operational values must be frequently adjusted to other coating conditions, for instance to bigger or lesser coating thicknesses and/or to match different objects, for instance uncoated or already coated objects, simple objects with large surfaces or complex objects with recesses and undercuts or apertures in the surface.

Further features of the invention are stated in the subclaims.

The invention is applicable both to liquid and to powder or granulate coating material.

BRIEF DESCRIPTION OF THE DRAWINGS

The invention is described below by means of a preferred embodiment and in relation to the attached drawing, which schematically shows the apparatus of the invention.

DETAILED DESCRIPTION OF THE DRAWINGS

Figure 1:
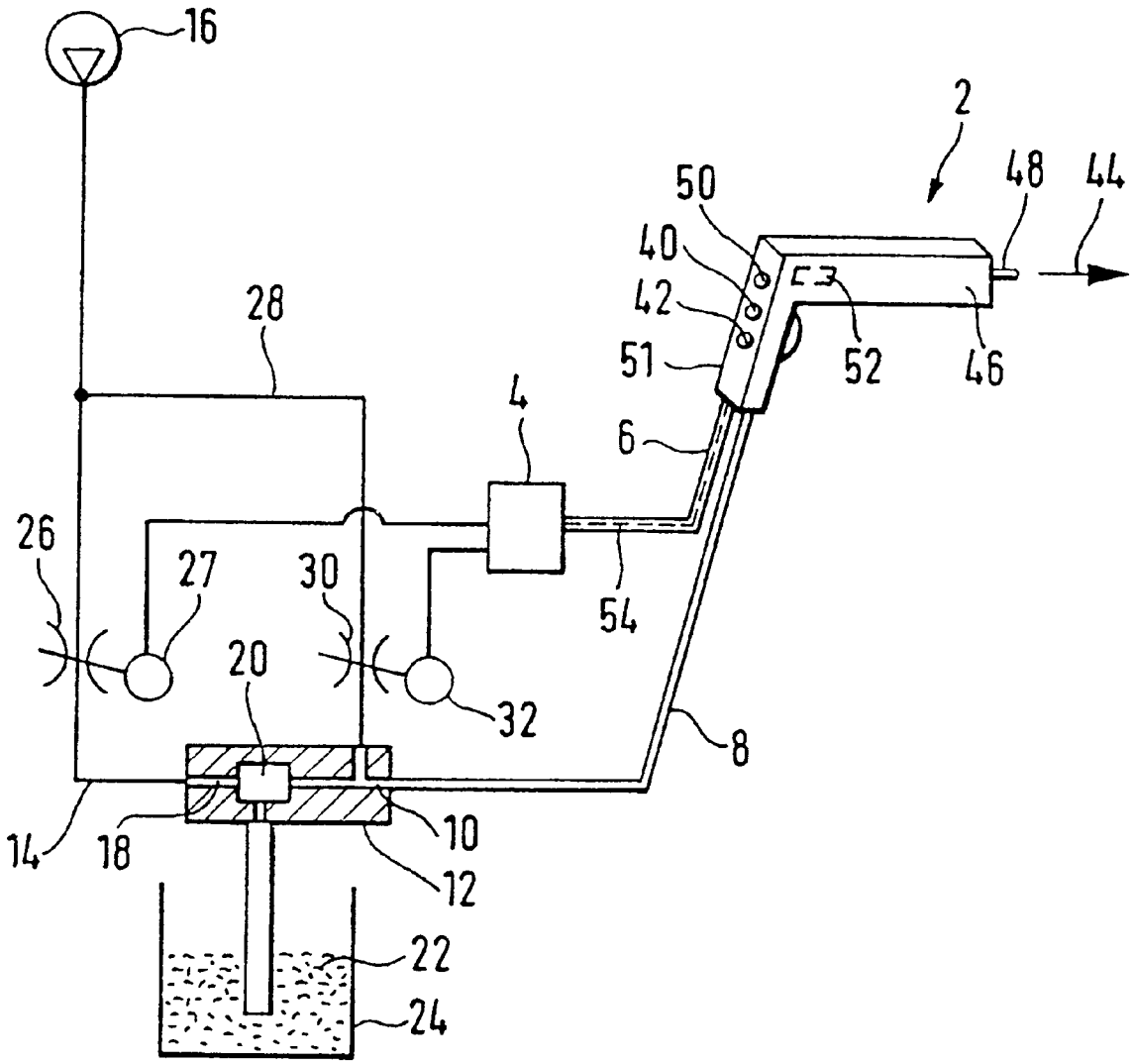

The drawing denoted by FIG. 1 shows a manual spray-coating gun 2 operating in concert with an electronic, and preferably computerized, control unit 4. The gun 2 is connected by a low-voltage cable 6 to the control unit 4 and by a hose 8 to the air/powder duct 10 of an injector 12. Compressed air from a compressed-air source 16 and acting as conveying air is fed through an air conveyance duct 14 to the injector 12. The conveyance air moves from an injector nozzle 18 into its axially opposite air/powder duct 10 and in the process creates a reduced pressure in a partial-vacuum zone 20 so that powder or granulate coating material 22 is sucked out of a container 24 into the flow of conveyance air. Within the conveyance air duct 14, the conveyance air is adjusted by an adjustable throttle and by means of a motorized adjusting element 27 to a nominal value which can be set manually or automatically at the control unit 4. The rate (volume/minute) of conveyance air is approximately proportional to the rate (gm/min) of coating material 22 which said conveyance air aspirates and conveys pneumatically. The use of a throttle 26 offers the advantage over a pressure regulator that changes in flow impedance taking place downward of said throttle—for instance kinks or loops in the hose 8 or different hose lengths being used—will preclude disadvantageous changes in the rate of coating material. Therefore a control design with feedback and a sensor to measure the actual values are not required.

An additional air feed duct 28 to supply additional compressed air from the compressed-air source 16 may be provided at the injector either at its partial-vacuum zone 20 or preferably downstream from same at the air/powder duct 10 for the purpose of controlling the powder flow in the hose 8. A throttle 30, which again preferably shall be adjustable, is mounted inside the additional air feed 28 and can be adjusted from the control unit 4 by a motor-driven setting element 32 to assume a nominal value which either is fed into the control unit 4 or preferably shall be computed by the control unit 4 in relation to the nominal value of the conveyance air of the air conveyance duct 14 and to a predetermined nominal value for the total air that shall flow into the hose 8.

A membrane key 40 denoted by a "+" sign and a membrane key 42 denoted by a "−" sign are mounted at the back side of the gun 2. Depressing the plus key 40 increases the powder output 44 at the gun's spray segment 46 and depressing the minus key 42 lowers the powder output 44. The powder output 44 is very easily adjusted at the control unit 4 because only requiring driving its setting element or the adjusting motor 27 of the conveyance air duct 14 and thereby the throttle 26.

In an especially easily applied embodiment, at least two, in this embodiment three, different coating modes are defined which are adjustable by changing the electrical high voltage and/or at least the electric spray current of at least one high-voltage electrode 48. The minimum of one high-voltage electrode 48 electrostatically charges the coating material 22 in manner known per se. When in this coating mode, another one may be selected by simultaneously depressing the membrane keys 40 and 42 at the control unit 4. Every time the two membrane keys 40 and 42 are depressed simultaneously by an operator of the gun 2, the coating mode shifts to the next one. Thus a shift will take place from the first to the second, then to the third, and then from the third to the first coating mode again. In order that the operator be notified which coating mode he did select, two light emitting diode (LEDs)s 50 are situated at the back side of the gun 2 and display the coating mode in effect. As regards the preferred embodiment mode, only one LED lights up in the first coating mode, then the other in the second coating mode, and in the third, both will blink alternatingly. The expression "coating mode" herein denotes the particular setting of a given nominal level of electrical high voltage and/or electrical spray current of the minimum of one high-voltage electrode 48, which then shall cooperate with the output of coating material that can be raised or lowered by depressing one of the two membrane keys 40 or 42.

As regards other embodiments, the setting of different coating modes automatically entails setting base values for the coating-material output, said initial values then being raised or lowered as desired by individually depressing either membrane key 40 or 42.

According to the preferred embodiment, one of the coating modes is appropriate for coating "simple" objects, another coating mode for coating "complex" objects and still another mode for coating "already pre-coated objects". As a result it is enough to set the appropriate coating mode for various objects. The operator no longer needs to adjust the high voltage, the electric spray current and/or the default setting for powder conveyance for various objects in the light of his own experience and by observing the particular circumstances.

Other embodiments furthermore make it possible to adjust the electrical high voltage and/or the electric spray current using separate keys or switches. Obviously the two membrane keys 40 and 42 also may be replaced by other keys or switches.

In the preferred embodiment of the present invention, the remote control between the gun 2 and the control unit 4 is technically implemented as follows: an electrical control circuit 52 comprising a quartz oscillator oscillating at very stable frequency is configured in a rear cover 51 of the gun 2. This frequency is transmitted by an electrical conductor 54 (wire or braid) in the low-voltage cable 6 to the control unit 4. When one of the membrane keys 40 or 42 is depressed, this frequency is divided by four and the frequency so divided is transmitted to the control unit 4. When the other membrane key 42 or 40 is depressed, then this frequency is divided by two and the frequency so divided is transmitted to the control unit 4. When both keys 40 and 42 are depressed simultaneously, the resulting frequency will only be ⅛ (one-eighth) of the original frequency. As a result only a single conductor 54 is needed in the low-voltage cable 6 for remote control between the gun 2 and the control unit 4 and this feature is very advantageous for the flexibility of this low-voltage cable 6.

The information about which coating mode was just selected also is transmitted by this single conductor 54 from the control unit 4 to the gun 2, namely as follows: the frequency output of the control circuit 52 in the gun 2 used in frequency transmission to the control unit 4 for the recognition of the membrane keys 40 and 42 is a so-called "current output". In other words, the control unit 4 may draw a varying current from the electrical conductor 54. The control circuit 52 in the gun 2 is designed in such manner that it can sense the current magnitude in this electric conductor 54. Depending on which coating mode is ON, the control unit 4 will drain a different current. This circumstance is detected by the control circuit 52 in the gun 2 which then turns ON the corresponding LED 50.

The two LED's 50 may be of different luminescent colors, for instance one being red and the other green. However, in one embodiment variation, other displays also may be used to display the particular coating mode. The LED's or other pilot lights or displays are powered through the control circuit 52 in the gun 2 by the electric voltage which the low-voltage cable 6 transmits from the control unit 4 of the control circuit 52 in the gun 2. This DC is about 5 v.

What is claimed is:

1. A manual spray-coating gun, comprising:

a coating-material feed for a coating material;

at least one high-voltage electrode for electrostatically charging the coating material when electrical power is applied to said high-voltage electrode;

a switching element for allowing manual switching ON/OFF said coating-material feed; and at least first and second manual setting/operating elements for manually adjusting at least one operational value of at least one of the coating material and the electrical power of said high-voltage electrode; wherein said first setting/operating element is configured to raise the at least one operational value when said first setting/operating element is actuated alone;

said second setting/operating element is configured to lower the at least one operational value when said second setting/operating element is actuated alone; and said first and second setting/operating elements are configured to implement further settings of operational values of at least one of the coating material and the electrical power when said first and second setting/operating elements are simultaneously actuated.

2. The manual spray-coating gun as claimed in claim 1, wherein said setting/operating elements are keys.

3. The manual spray-coating gun as claimed in claim 1, further comprising a barrel and a grip, wherein said setting/operating elements are positioned on a back side of the gun in an actuation zone of a thumb of a hand holding said gun by the grip.

4. The manual spray-coating gun as claimed claim 1, wherein said at least one operational value being adjusted by actuation of one of said setting/operating elements is output of the coating material; and said setting/operating elements are configured so as to set, when said setting/operating elements are simultaneously actuated, at least one of an electrical voltage and an electrical spray current of said high-voltage electrode to a predetermined value.

5. The manual spray-coating gun as claimed in claim 4, further comprising an optical indicator configured to generate an optical signal corresponding to said predetermined value when said setting/operating elements are simultaneously actuated.

6. A spraying-coating system, comprising a manual spray-coating gun and a control unit electrically connected to said gun, said gun comprising:

a coating-material feed for a coating material;

at least one high-voltage electrode for electrostatically charging the coating material when electrical power is applied to said high-voltage electrode;

a switching element for allowing manual switching ON/OFF said coating-material feed; and at least first and second manual setting/operating elements for manually adjusting at least one operational value of an operational medium comprising at least one of the coating material and the electrical power of said high-voltage electrode, wherein said first setting/operating element is configured to raise the at least one operational value when said first setting/operating element is actuated alone, said second setting/operating element is configured to lower the at least one operational value when said second setting/operating element is actuated alone, and said first and second setting/operating elements are configured to implement further settings of operational values of said operational medium when said first and second setting/operating elements are simultaneously actuated;

wherein said control unit is located outside said gun and configured to control said operational medium; and said gun further comprises an electrical circuit which is configured to, depending on actuation of at least one of said setting/operating elements, generate a signal of a frequency selected among a plurality of different, predetermined frequencies, and transmit said signal to said control unit which, in turn, is configured to set, as a function of the selected frequency, a predetermined operational value for said operational medium.

7. The spray-coating system as claimed in claim 6, wherein the electric circuit comprises an oscillator vibrating at a stable frequency;

upon actuation of said first setting/operating element, the selected frequency of said signal is obtained by dividing said stable frequency by a first predetermined number;

upon actuation of said second setting/operating element, the selected frequency of said signal is obtained by dividing said stable frequency by a second predetermined number; and upon simultaneous actuation of said first and second setting/operating elements, the selected frequency of said signal is obtained by dividing said stable frequency by a third predetermined number.

8. The spray-coating system as claimed in claim 7, wherein said gun and said control unit are connected by an electrical conductor;

said gun further comprises an optical indicator configured to generate an optical signal corresponding to said predetermined optional value;

said control unit is configured to drain different current levels from the electrical conductor as a function of the selected frequency; and said electric circuit is configured to detect the different current levels, and as a function thereof, actuate said optical indicator to generate said optical signal.

9. The spray-coating system as claimed in claim 7, wherein said gun and said control unit are connected by a single electrical conductor which transmits said signal of the selected frequency from the electric circuit of the spray-coating gun to the control unit.

10. A spraying-coating system, comprising: a compressed-air duct, a coating-material-conveying injector coupled to said compressed-air duct, an adjustable throttle installed in said compressed-air duct for adjusting a flow of compressed air being fed through said compressed-air duct to said coating-material-conveying injector, and a manual spray-coating gun, said gun comprising:

a coating-material feed coupled to receive a coating material from said coating-material-conveying injector;

at least one high-voltage electrode for electrostatically charging the coating material when electrical power is applied to said high-voltage electrode;

a switching element for allowing manual switching ON/OFF said coating-material feed; and at least first and second manual setting/operating elements for manually adjusting at least one operational value of at least one of the coating material and the electrical power of said high-voltage electrode, wherein said first setting/operating element is configured to raise the at least one operational value when said first setting/operating element is actuated alone, said second setting/operating element is configured to lower the at least one operational value when said second setting/operating element is actuated alone, and said first and second setting/operating elements are configured to implement further settings of operational values of at least one of the coating material and the electrical power when said first and second setting/operating elements are simultaneously actuated.

11. A manual spray-coating gun, comprising:

a coating-material feed for a coating material;

at least one electrode for electrostatically charging the coating material when electrical power is applied to said electrode; and at least first and second manual controlling elements for manually adjusting an operational value of at least one parameter of at least one of the coating material and the electrical power of said electrode; wherein said first controlling element is configured to raise the operational value when said first controlling element is actuated alone;

said second controlling element is configured to lower the operational value when said second controlling element is actuated alone; and said first and second controlling elements are configured to set at least one parameter of at least one of the coating material and the electrical power to a predetermined value when said first and second controlling elements are simultaneously actuated.

12. The gun of claim 11, wherein said controlling elements are keys.

13. The gun of claim 11, further comprising a barrel and a grip, wherein said controlling elements are positioned on a back side of the gun in an actuation zone of a thumb of a hand holding said gun by the grip.

14. The gun of claim 11, wherein said at least one parameter being adjusted by actuation of one of said controlling elements comprises output of the coating material; and said at least one parameter being set to the predetermined value by simultaneous actuation of said controlling elements comprises at least one of an electrical voltage and an electrical spray current of said electrode.

15. The gun of claim 14, further comprising an optical indicator configured to generate an optical signal corresponding to the predetermined value when said controlling elements are simultaneously actuated.

16. The gun of claim 11, having an operational coating mode that sequentially shifts among a plurality of preset coating modes when simultaneous actuation of said controlling elements is repeated.

* * * * *